US005655488A

United States Patent [19]

Hampton et al.

[11] Patent Number: 5,655,488

[45] Date of Patent: Aug. 12, 1997

[54] DUAL EVENT VALVE CONTROL SYSTEM

[75] Inventors: Keith Hampton, Ann Arbor; Don J. Krzysik, Oxford; Bryce A. Buuck, Bellevue, all of Mich.

[73] Assignee: Eaton Corporation, Cleveland, Ohio

[21] Appl. No.: 684,671

[22] Filed: Jul. 22, 1996

[51] Int. Cl.[6] ..... F01L 13/00; F01L 1/18

[52] U.S. Cl. ..... 123/90.16; 123/90.41; 123/90.46

[58] Field of Search ..... 123/90.15, 90.16, 123/90.17, 90.27, 90.36, 90.39, 90.41, 90.42, 90.43, 90.44, 90.46, 198 F

[56] References Cited

U.S. PATENT DOCUMENTS

| | | | |
|---|---|---|---|
| 4,151,817 | 5/1979 | Mueller | 123/90.16 |
| 4,556,025 | 12/1985 | Morita | 123/198 F |
| 5,203,289 | 4/1993 | Hara et al. | 123/90.16 |
| 5,452,694 | 9/1995 | Hara | 123/90.16 |
| 5,524,580 | 6/1996 | Muir | 123/90.16 |
| 5,529,033 | 6/1996 | Hampton | 123/90.16 |
| 5,544,626 | 8/1996 | Diggs et al. | 123/90.16 |

FOREIGN PATENT DOCUMENTS

| | | |
|---|---|---|
| 4136143 | 5/1993 | Germany . |
| 2185784 | 7/1987 | United Kingdom . |

*Primary Examiner*—Weilun Lo
*Attorney, Agent, or Firm*—Frank M. Sajovec

[57] ABSTRACT

A dual event valve control system for an internal combustion engine. The system includes an inner rocker arm in engagement with a valve and with a first cam, an outer rocker arm in engagement with a second cam, and a latch member which is insertable between the rocker arms, whereupon when the rocker arms do not engage the latch member, the rocker arms are free to pivot independently of one another and the valve is actuated by the first rocker arm in accordance with the lift profile of the first cam, and when the rocker arms are engaged by the latch member, the rocker arms rotate in unison and the valve is actuated by the second rocker arm in accordance with the lift profile of the second cam. A stop acting between the inner and outer rocker arms limits relative pivoting movement between the rocker arms and is effective to provide clearance between the base circle portion of its second cam and the outer rocker arm.

8 Claims, 3 Drawing Sheets

DUAL EVENT VALVE CONTROL SYSTEM

The present invention relates to valve operating apparatus for an internal combustion engine, and more particularly to apparatus to vary the operational characteristics of the intake or exhaust valves in such engines during various operational modes of the engine.

Variable valve control systems for multiple valve engines wherein the intake and/or exhaust valves can either be selectively actuated or actuated at selected lift profiles, are known in the art. U.S. Pat. No. 4,151,817 discloses a system which includes a primary rocker arm element engageable with a first cam profile, a secondary rocker arm element pivotally mounted on the primary rocker arm element and engageable with a second cam profile, and means to interconnect or latch the primary and secondary rocker arm elements. U.S. patent application Ser. No. 412,474, filed Mar. 28, 1995, discloses a system which includes inner and outer rocker arms pivotally mounted on the output member of a stationary lash adjuster, wherein the outer rocker arm is in engagement with the engine valve and the inner rocker arm is in engagement with the cam, and wherein a latch member is selectively inserted between contact surfaces of the inner and outer rocker arms to effectively latch the rocker arms together to transmit a valve opening force from the cam to the outer rocker arm. When the rocker arms are in an unlatched condition the outer rocker arm is free to rotate relative to the inner rocker arm and no opening force is transmitted to the outer rocker arm.

It is an object of the present invention to provide a dual event valve control system wherein an engine valve is selectively actuated by one of two different cam profiles and which is actuated by means of a latch member which is selectively inserted between contact elements formed on inner and outer rocker arms to cause the rocker arms to move in unison to actuate the valve according to a first cam profile when the latch member is inserted between the rocker arms and to permit the rocker arms to move relative to one another to actuate the valve according to a second cam profile when the latch member is not inserted between the rocker arms.

To meet the above objective, the present invention provides a rocker arm assembly which includes an inner rocker arm in engagement with the valve and having a roller mounted thereon in engagement with a first cam, an outer rocker arm in surrounding relation to the inner arm and having surfaces formed thereon which contact second cams, and a latch member which is movable between a first position wherein it is out of engagement with the inner and outer rocker arms and a second position wherein it is inserted between contact surfaces on the inner and outer arms to interfere with relative rotation of the arms and thus effectively latch the arms together. The cams are configured such that the second cams have a higher lift profile than the first cam. When the latch member is in its first position the force of the second cam is not transmitted to the inner arm and only the low lift cam acting directly on the inner arm is effective to open the valve. In the second position of the latch member the force of the second cams is transmitted from the outer rocker arm to the inner rocker arm and thus to the valve, the low lift cam profile being ineffective in this mode of operation. To reduce wear, stop means are provided to limit relative separating movement between the inner and outer rocker arms such that a gap, or lash, is maintained between the second cam and the cam contacting surfaces of the outer rocker arm.

Other objects and advantages of the invention will be apparent from the following description when considered in connection with the accompanying drawings, wherein.

Figure 1:
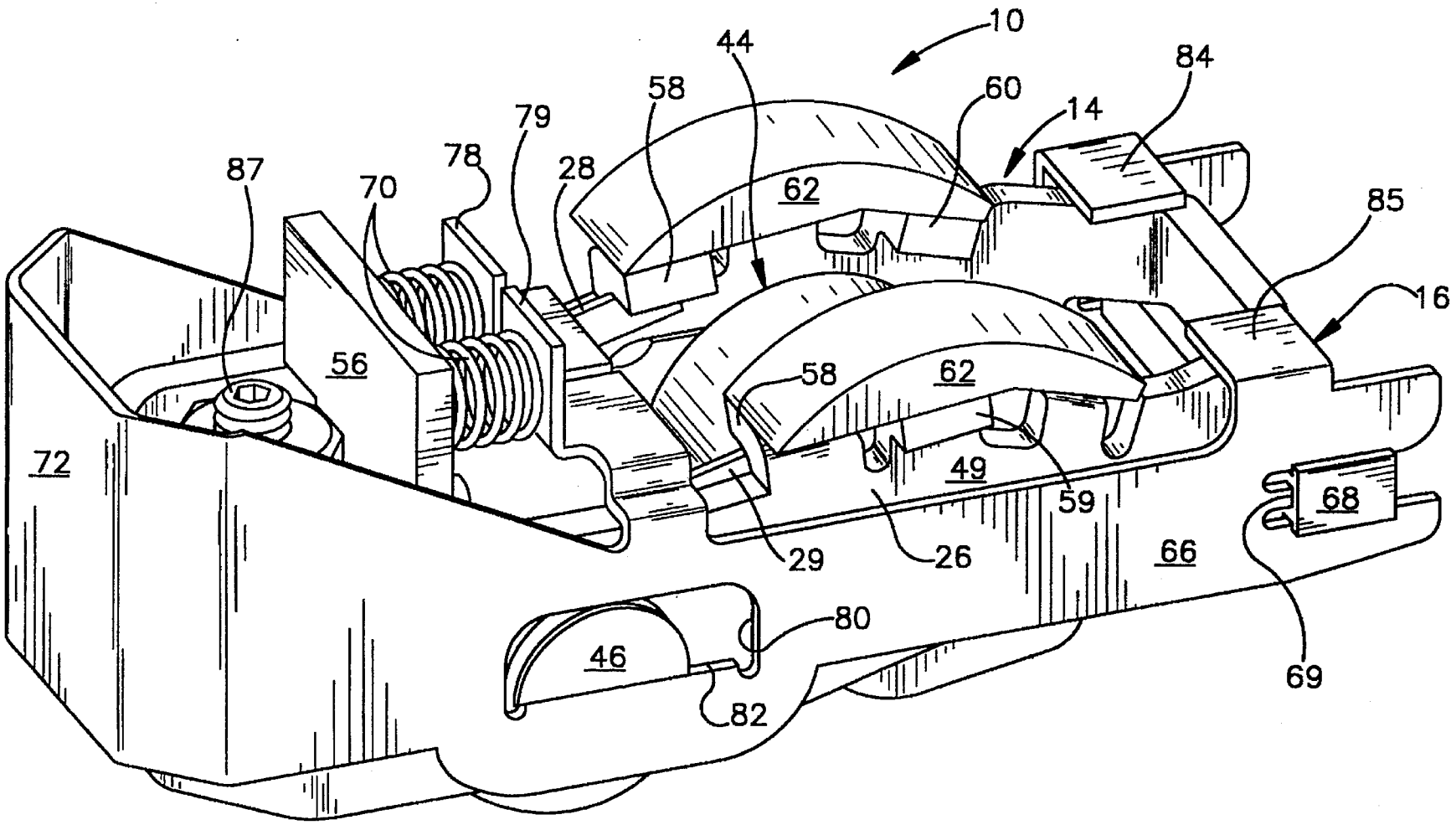
FIG. 1 is a perspective view of the invention.

Referring to the drawings, there is illustrated a valve control system 10 particularly adapted for use in an internal combustion engine (not shown) of the overhead cam type. As illustrated herein the system 10 is operable to open a poppet valve 12 (see FIG. 4) in response to either one of two distinct cam profiles, and comprises a rocker arm assembly 14 and a latch assembly 16 which is operable to shift the rocker arm assembly between its two operating modes. In the embodiment illustrated herein a first cam 18 (FIG. 3) defines the first operating mode, and one or more second cams 20 define the second operating mode.

The rocker arm assembly 14 comprises an inner rocker arm 22 which is engageable with the first cam 18 formed on a camshaft 24 and with the valve 12 (FIG. 4), an outer rocker arm 26 which is engageable with the second cams 20 and by pair of springs 28 and 29 which bias the rocker arm 26 into engagement with the cam 20. The rocker arm assembly is pivotally mounted on the cylinder head 31 of the engine, and in the preferred embodiment shown in FIG. 4, it is mounted on the output member 30 of a hydraulic lash adjusted 32. The construction and the function of the lash adjuster are well known and will not be described in detail herein.

Figure 2:
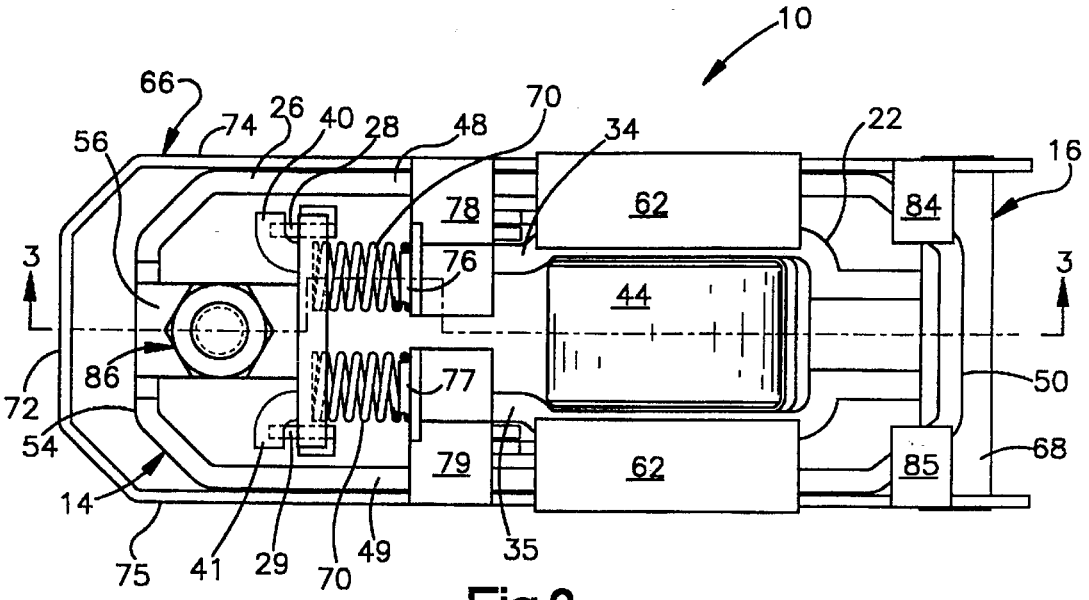
FIG. 2 is a plan view of the invention.
Figure 3:
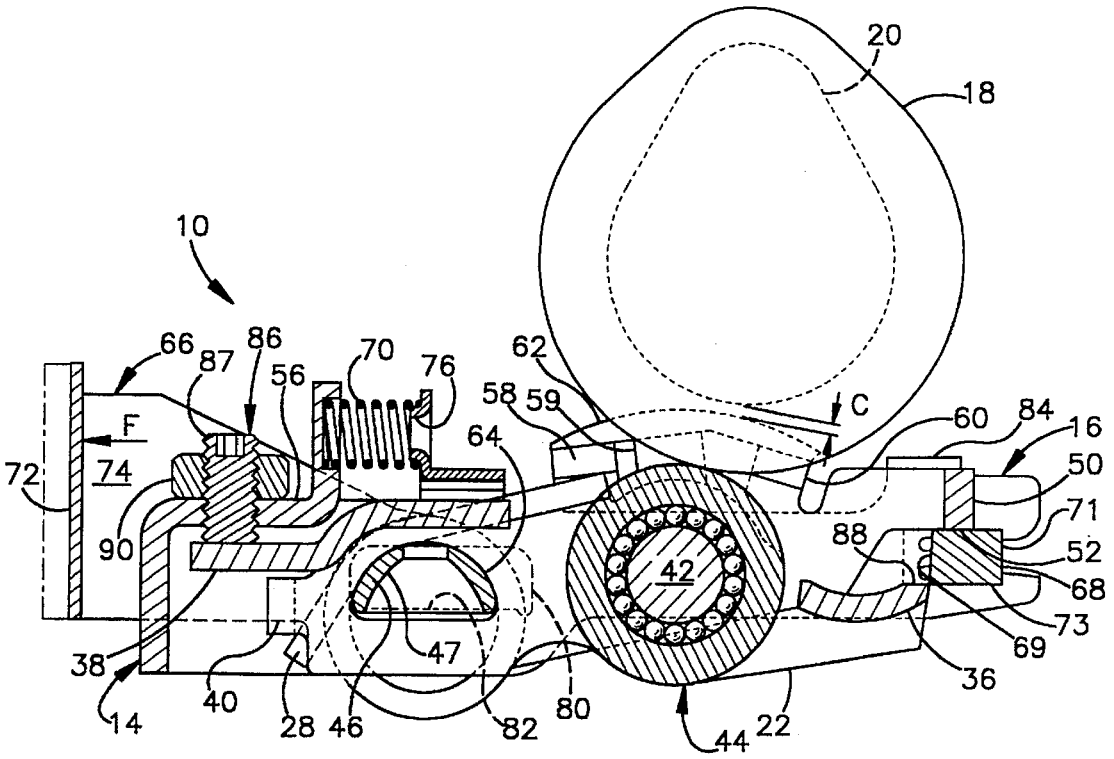
FIG. 3 is a sectional view taken along line 3—3 of FIG. 2.

Referring particularly to FIGS. 2 and 3, the inner rocker arm 22 comprises a stamped box-like member having spaced apart side walls 34, 35, a first end which converges to define a valve contacting element 36, and a second end in the form of a spine 38, the function of which will be described in further detail below. The ends of the side walls 34, 35 adjacent the spine are bent outward to define tabs 40, 41 which serve as stops for one end of the springs 28, 29. Aligned bores (not shown) are formed in the side walls to receive an axle 42 of a roller assembly 44 which defines a first follower engageable with the first cam 18.

The inner arm is mounted on a fulcrum defined by a bar 46 which is received through apertures formed in the side walls of the inner and outer rocker arms, as will be described in more detail below.

The outer rocker arm 26 is a box-like structure which, as best shown in FIG. 2, is received in surrounding relation to the inner arm 22. The outer arm includes spaced apart side walls 48, 49, a first end wall 50 having a first contact surface 52 formed thereon, and a second end wall 54, which has a central spine 56 formed thereon, the function of which will be described below. Each of the side walls 48 and 49 has tabs 58, 59, 60 formed thereon to which pads 62 are brazed or otherwise attached, the pads 62 defining second followers engageable by the second cams 20, which in the preferred embodiment straddles the cam 18.

Figure 4:
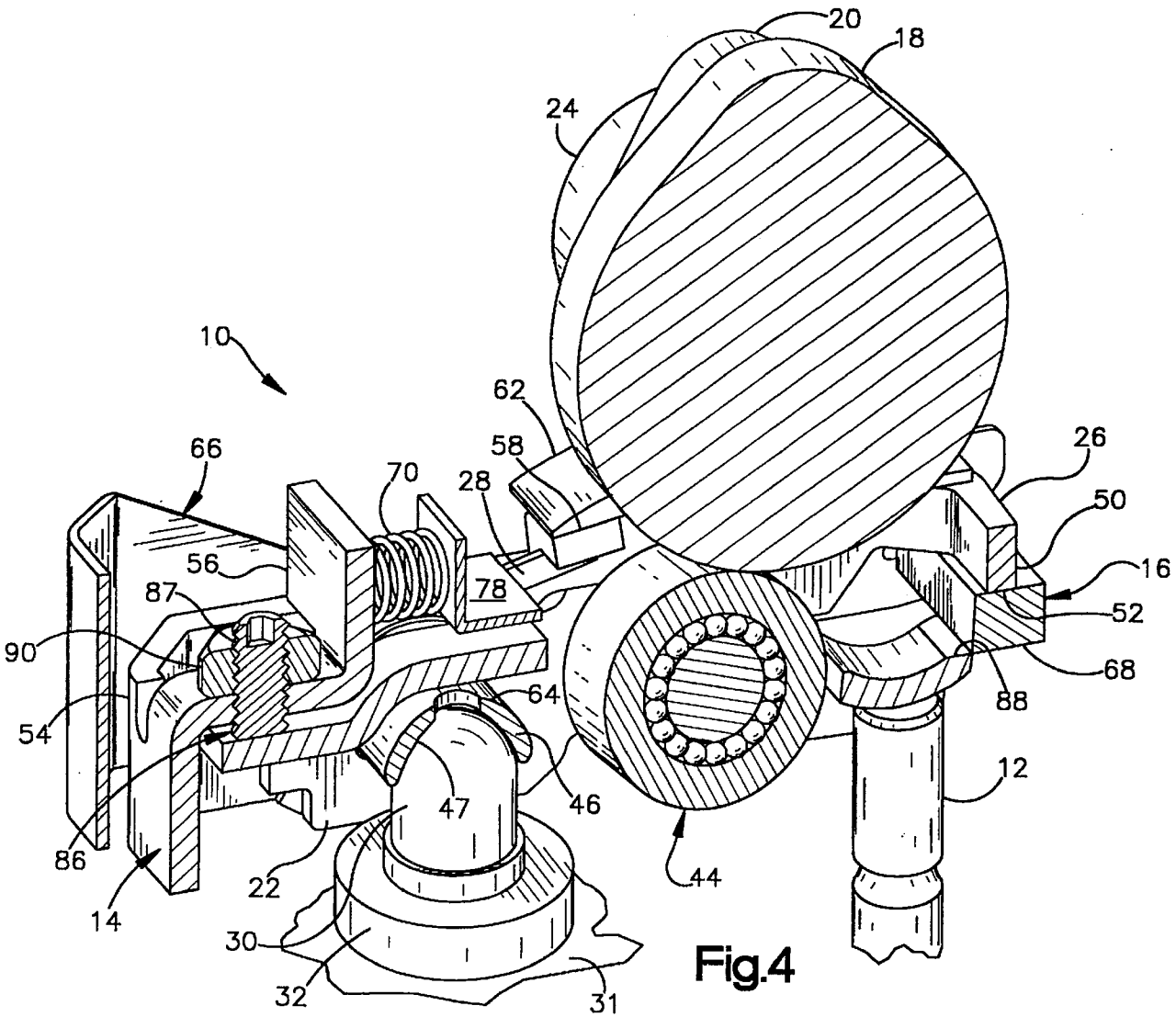
FIG. 4 is a perspective sectional view of the invention.

Referring particularly to FIG. 4, the outer rocker arm is mounted for pivotal movement about the output member 30 of the lash adjuster 32 by means of the bar 46, which has a centrally located socket 47 formed therein which is engageable with a ball end formed on the output member, and which is received through apertures formed in the side walls 48 and 49. The apertures formed in the walls 48 and 49 of the outer rocker arm are formed with minimal clearance with the bar 46 such that there is essentially no relative movement between the arm and the bar. The apertures formed in the inner arm 22, however, are somewhat larger than the bar 46 such that the inner arm can pivot about the arcuate upper surface 64 of the bar.

The latch assembly 16 comprises a slide member 66 which essentially surrounds the outer rocker arm 26 and which is received in sliding relation thereto, a latch member 68 mounted on the slide member, and a pair of springs 70 which act between the slide member and the outer rocker arm to bias the latch assembly into the position shown in full line in the drawings.

The slide member 66 is a sheet metal structure formed as an elongated U in plan view having a flat end wall 72 formed at the base of the U, side walls 74 and 75 in sliding contact with the side walls of the outer rocker arm, and U-shaped openings (in elevation) formed in the ends of the legs of its open end to receive the latch member 68, which is in the form of a solid bar spanning the side walls of the slide member. The latch member is slotted (not shown) adjacent the ends thereof, and the side walls 74, 75 of the slide member 66 are received within the slots to retain the latch member laterally. The latch member butts up against stop surfaces 69 formed in the side walls and is retained axially by shoulders 71, 73 formed in the side walls which are snapped over the latch member. Springs 70 are retained by depressions formed in an upwardly bent portion of spine 56 and by cylindrical seats 76, 77 formed on inwardly and upwardly bent tabs 78, 79 formed on the side walls of the slide member. The bar 46 is received through apertures 80 formed in the walls 74, 75, and the bar is retained laterally by ledges 82 formed at the lower edge of the apertures 80 which engage shoulders (not shown) formed at the ends of the bar. When the unit is assembled the bar 46 is received in the inner and outer arms, and the sheet metal slide member 66 is sprung over the ends of the bar with the ledges 82 engaging the bar. The aperture 80 is elongated to permit sliding movement of the slide member relative to the rocker arms. Inwardly directed tabs 84, 85 are formed on the walls of the slide member to maintain the latch member 68 in engagement with the contact surface 52 of the outer rocker arm.

When the inner and outer rocker arms and the latch assembly are assembled and positioned as shown in FIG. 3 in relation to the cams 18, 20, the valve 12 and the lash adjuster 32, the torsion springs 28 and 29 are received over the bar 46 with one end bearing against the tabs 40, 41 on the inner rocker arm 22 and the other end against the tabs 58 on the outer arm to bias the outer arm toward engagement with the cams 20 via the pads 62.

In accordance with the invention clearance is maintained between the pads 62 and the base circles of cams 20 by means of a stop assembly 86, which limits the relative pivotal movement between the inner and outer rocker arms. In the preferred embodiment shown herein the stop assembly comprises a screw 87 which is threaded through the spine 56 of the outer rocker arm and bears against the spine 38 of the inner rocker arm. The screw is adjusted so that a clearance C is maintained between the cams 20 and the pads 62 on base circle, as shown in FIG. 3, the position of the screw being maintained by lock nut 90. Once the clearance C is set, the lash between the latch member 68 and the contact surface 88 of the inner rocker arm is set by selecting a latch member having a vertical dimension (as viewed in FIG. 3) which provides the desired lash. It can be appreciated that a fixed stop can be provided in place of the assembly 86 to limit the relative pivotal movement of the rocker arms, such as by controlling the clearance between the spines 38 and 56.

OPERATION

In the embodiment illustrated the cams 20 engaged by the pads 62 define a high lift cam profile, while the cam 18 engaged by the roller 44 defines a low lift cam profile. When the system is in the condition illustrated in full line in the drawings, the springs 70 bias the slide assembly 66 to the right relative to the rocker arms to place the latch member out of engagement with the contact surface 88 on the inner rocker arm. In this condition movement of the outer rocker arm 26 in response to the force of the cams 20 acting on the pads 62 is not transmitted to the inner rocker arm and thus not to the valve 12; therefore, the valve is actuated by the low lift profile of the cam 18 acting on the roller 44. To open the valve by the high lift profile of the cams 20, the latch assembly is moved to the left against the force of springs 70 by applying a force F to the slide member 66 (FIG. 3), moving the latch member 68 between the contact surfaces 52 and 88 on the outer and inner rocker arms, respectively to the broken line position of FIG. 3. This effectively latches the rocker arms together so that the force of the cams 20 is transmitted from the outer rocker arm to the inner rocker arm through the latch member 68, thus actuating the valve by the high lift profile of the cams 20. Since the cams 20 provide higher lift than the cam 18, the cam 18 is ineffective in this mode of operation.

It can be appreciated than the force F can be provided by a solenoid or other conventional means for applying a linear force to the slide member 66.

We claim:

1. A valve control system for an internal combustion engine including a cylinder head, a poppet valve movable within said cylinder head between an open and closed condition, and a camshaft having a first cam with a first cam profile formed thereon and a second cam having a second cam profile formed thereon; said control system comprising a first rocker arm mounted for rotation on said cylinder head, said first rocker arm having a surface formed thereon in engagement with said poppet valve and having a first cam follower element thereon in engagement with said first cam; a second rocker arm mounted for rotation on said cylinder head, said second rocker arm having a second cam follower element formed thereon engageable with said second cam; means biasing said second rocker arm into engagement with said second cam, and means engageable with said first and second rocker arms and moveable between a first position out of engagement with said rocker arms wherein said rocker arms are free to rotate relative to one another in response to the respective profiles of said first and second cams and a second position in engagement with said first and second rocker arms wherein said first and second rocker arms rotate in unison in response to said second cam profile; the improvement comprising stop means on said first and second rocker arms operable to limit relative rotation therebetween, wherein said stop means is effective to provide a clearance between the base circle portion of said second cam and said second cam follower element.

2. Apparatus as claimed in claim 1, including a first contact surface formed on said first rocker arm; a second contact surface formed on said second rocker arm, said means engageable with said first and second rocker arms comprising a latch member insertable between said first and second contact surfaces; and means biasing said latch member into said first position.

3. Apparatus as claimed in claim 1, in which said means biasing said second rocker arm into engagement with said second cam comprises a torsion spring having one end bearing against said first rocker arm and the other end bearing against said second rocker arm.

4. Apparatus as claimed in claim 1, in which said stop means comprises a screw member threaded through either of said first and second rocker arms and engageable with the other of said first and second rocker arms.

5. Apparatus as claimed in claim 4, in which said outer rocker arm has a first substantially centrally located and horizontally oriented spine section formed thereon, and said inner rocker arm has a second substantially centrally located and horizontally oriented spine section formed thereon and spaced from said first spine section; said screw member being threaded through said first spine section and engageable with said second spine section.

6. Apparatus as claimed in claim 1, including a hydraulic lash adjuster mounted in a stationary position in relation to said cylinder head, said lash adjuster having an output member extending therefrom; said first and second rocker arms being rotatable about said output member.

7. Apparatus as claimed in claim 6, in which said second rocker arm comprises spaced apart side walls; said first rocker arm comprises spaced apart side walls received between the side walls of said second rocker arm; said apparatus including a fulcrum defined by an elongated bar received through the side walls of said first and second rocker arms in apertures formed therein, said bar having an arcuate upper surface and socket formed in its lower surface and said apertures being sized to permit substantially no relative rotation between said second rocker arm and said fulcrum and at least limited relative rotation between said first rocker arm and said fulcrum; said socket being in engagement with the output member of said lash adjuster.

8. Apparatus as claimed in claim 7, in which said means biasing said second rocker arm into engagement with said second cam comprises first and second torsion springs received in surrounding relation to said fulcrum between respective adjacent side walls of said, first and second rocker arms, one end of each of said torsion springs being in engagement with said first rocker arm and the opposite end of each of said torsion springs being in engagement with said second rocker arm.

* * * * *